United States Patent [19]

Rozga

[11] 4,097,042

[45] Jun. 27, 1978

[54] BACKSTOP CONSTRUCTION FOR A STACKING MACHINE

[75] Inventor: Vincent E. Rozga, Greendale, Wis.

[73] Assignee: Kelley Company, Inc., Milwaukee, Wis.

[21] Appl. No.: 771,976

[22] Filed: Feb. 25, 1977

[51] Int. Cl.[2] ..... B65H 31/20

[52] U.S. Cl. ..... 271/171; 271/224

[58] Field of Search ..... 271/224, 223, 163, 164, 271/171, 193

[56] References Cited

U.S. PATENT DOCUMENTS

| | | | |
|---|---|---|---|
| 3,256,011 | 6/1966 | Buccicone | 271/180 X |
| 3,369,806 | 2/1968 | Buccicone | 271/224 |
| 3,558,128 | 1/1971 | Buccicone | 271/224 |

*Primary Examiner*—Richard A. Schacher

*Attorney, Agent, or Firm*—Andrus, Sceales, Starke & Sawall

[57] ABSTRACT

A backstop construction for a sheet stacking machine. The sheet stacking machine includes a vertically movable table to receive sheets to be stacked and a truck is disposed above the table and is mounted to move on the frame in a front to rear direction. A backstop is carried by a carriage that is mounted for movement on the truck, and the backstop is adapted to be engaged by the forward edges of the sheets as they are stacked on the table. Movement of the truck with respect to the frame of the machine will adjust the position of the backstop for various lengths of sheets, and the backstop can also be moved between a rear and forward position on the carriage, so that the entire length of the frame can be utilized to accommodate the shortest and longest lengths of sheets.

11 Claims, 7 Drawing Figures

BACKSTOP CONSTRUCTION FOR A STACKING MACHINE

BACKGROUND OF THE INVENTION

In the manufacture of corrugated paperboard, paper sheets are bonded with an adhesive to opposed faces of a corrugated core and the laminated sheet is then passed through a slitter which slits the sheet into strips of predetermined widths. The slit strips are then passed through a cut-off knife which cuts the slit strips into lengths. Following the cutting, the cut lengths or sheets are conveyed on an endless belt conveyor to a stacking mechanism where the cut sheets are stacked in piles.

U.S. Pat. No. 3,905,595 describes a sheet stacking mechanism which includes a lift table that receives the sheets and is mounted for vertical movement on the frame of the machine. As the sheets are stacked on the table, the table is automatically lowered so that the top of the stack remains below the level of the conveyor. A backstop is mounted on the frame and the forward edges of the sheets engage the backstop as they are stacked on the table to align the sheets.

When the stack reaches a predetermined height, the delivery of the conveyor is momentarily interrupted and the stack is removed from the table by a roller conveyor. The table is then elevated to the level of the conveyor which is restarted to begin a new stack.

In some sheet stacking machines the backstop is carried by a truck which is mounted for movement in a front-to-rear direction with respect to the frame, so that the machine can accommodate sheets of different lengths. In practice, the truck has a front to rear length of about 24 inches in order to provide stability of movement of the truck with respect to the frame. In normal operation, the backstop is located adjacent the front end of the truck and when the truck is moved to the rear of the frame for stacking sheets of longer length, the backstop is a substantial distance from the rear end of the machine. Thus, in the conventional stacking machine, approximately 20 inches of space at the rear end of the machine is wasted and cannot be utilized for stacking sheets.

SUMMARY OF THE INVENTION

The invention relates to an improved backstop construction for a sheet stacking machine. In accordance with the invention, a truck is disposed above the lift table of the sheet stacking machine and is mounted to move on the frame in a front-to-rear direction. The backstop is carried by a carriage which, in turn, is mounted for movement in a front-to-rear direction with respect to the truck. Movement of the truck with respect to the frame will adjust the position of the backstop and a further adjustment is achieved by moving the backstop relative to the carriage, so that the entire length of the frame of the machine can be utilized to accommodate the shortest and longest lengths of sheets.

The backstop is preferably biased to a rear position with respect to the carriage and can be manually moved forwardly and locked in a forward position by a latching mechanism. On release of the latching mechanism the backstop will automatically be urged to its rearmost position on the carriage.

With the construction of the invention, the entire bed or frame of the sheet stacking machine can be utilized for stacking sheets thereby enabling sheets of greater length to be stacked utilizing a machine frame of given size, or alternately, the length of the machine frame can be reduced for stacking of sheets of given length.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
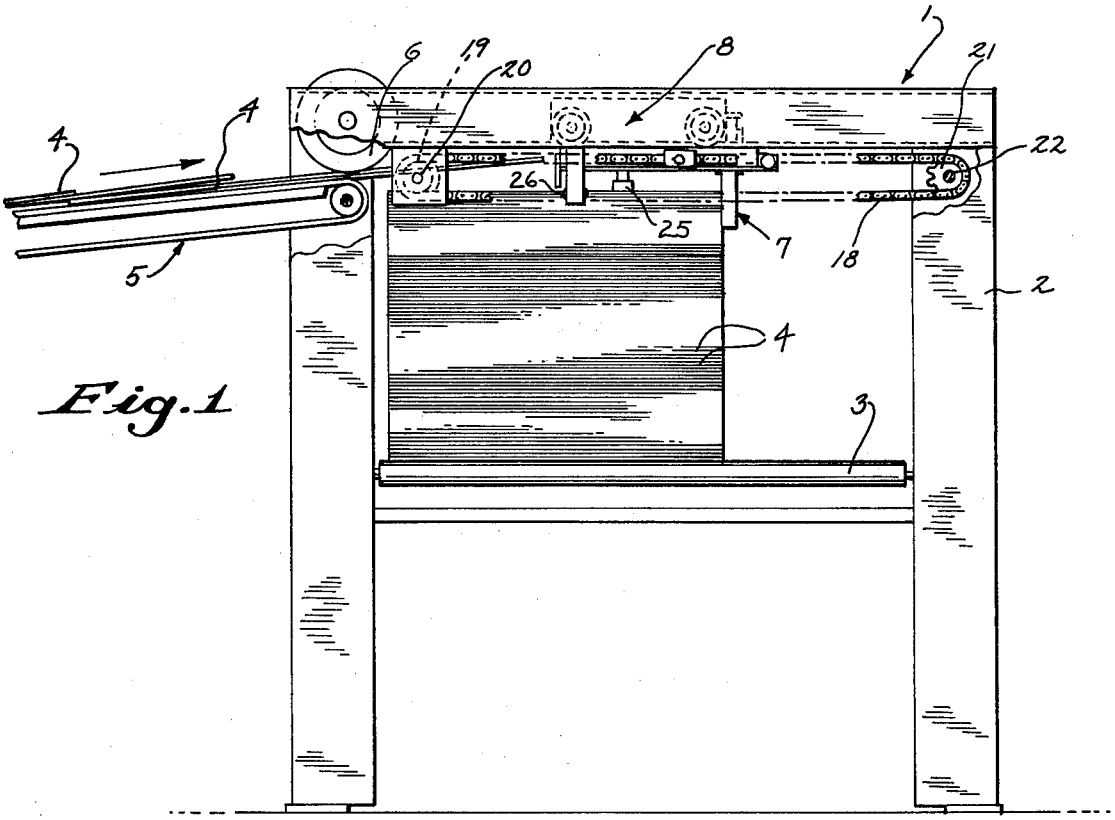
FIG. 1 is a side elevation of the sheet stacking machine incorporating the backstop construction of the invention.

FIG. 1 illustrates a sheet stacking machine to be used for stacking sheets of corrugated paperboard as they are conveyed from the cut-off machine. The general operation of the stacking machine is similar to that described in U.S. Pat. No. 3,905,595. The stacking machine 1 includes a frame or supporting structure 2 and a lift table 3 is mounted for vertical movement with respect to the frame 2. A series of cut sheets or lengths 4 of sheet material, such as corrugated paperboard, are conveyed to the stacking machine by an endless belt conveyor 5 and rollers 6 engage the upper surfaces of the sheets as they enter the machine to aid in guiding the sheets onto the table 3. A backstop 7 is mounted on the frame 2 and is positioned to be engaged by the forward end of each cut sheet 4 as it is moved onto the lift table 3, thereby aligning the stack of sheets on the table.

As the sheets pile up on the table 4, the table is automatically lowered so that the top of the stack remains below the level of the conveyor 5. When the stack reaches a predetermined height, the conveyor is momentarily stopped and the stack is moved from the lift table by rollers incorporated therein.

After removal of the stack, the lift table 3 is then raised to the level of the conveyor belt 5 which is subsequently restarted to thereby form a new stack on the lift table.

A truck 8 is disposed above the lift table 3 and is mounted for movement on the frame 2 in a front-to-rear direction, and the backstop 7 is carried by a carriage 9 which is mounted for movement in the front-to-rear direction with respect to the truck 8.

Figure 2:
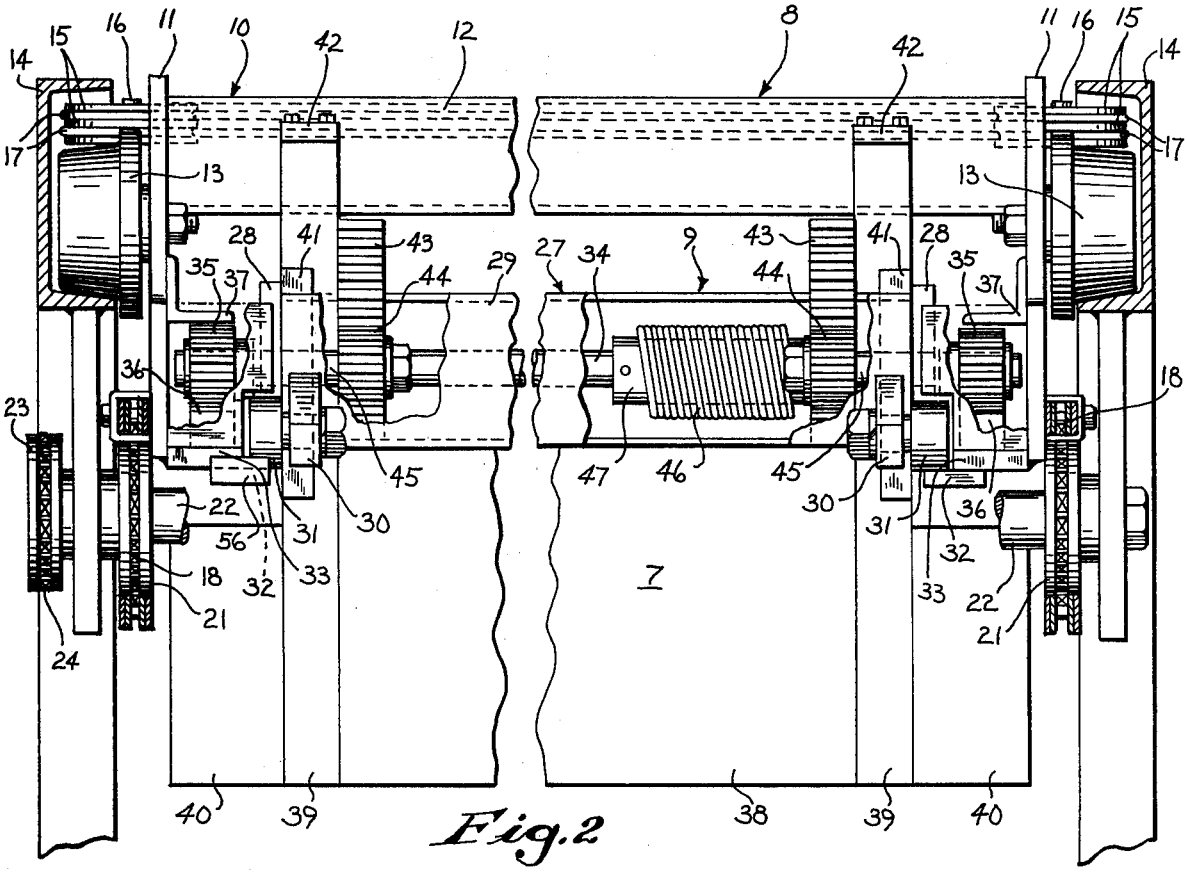
FIG. 2 is a rear elevation of the back stop construction.
Figure 3:
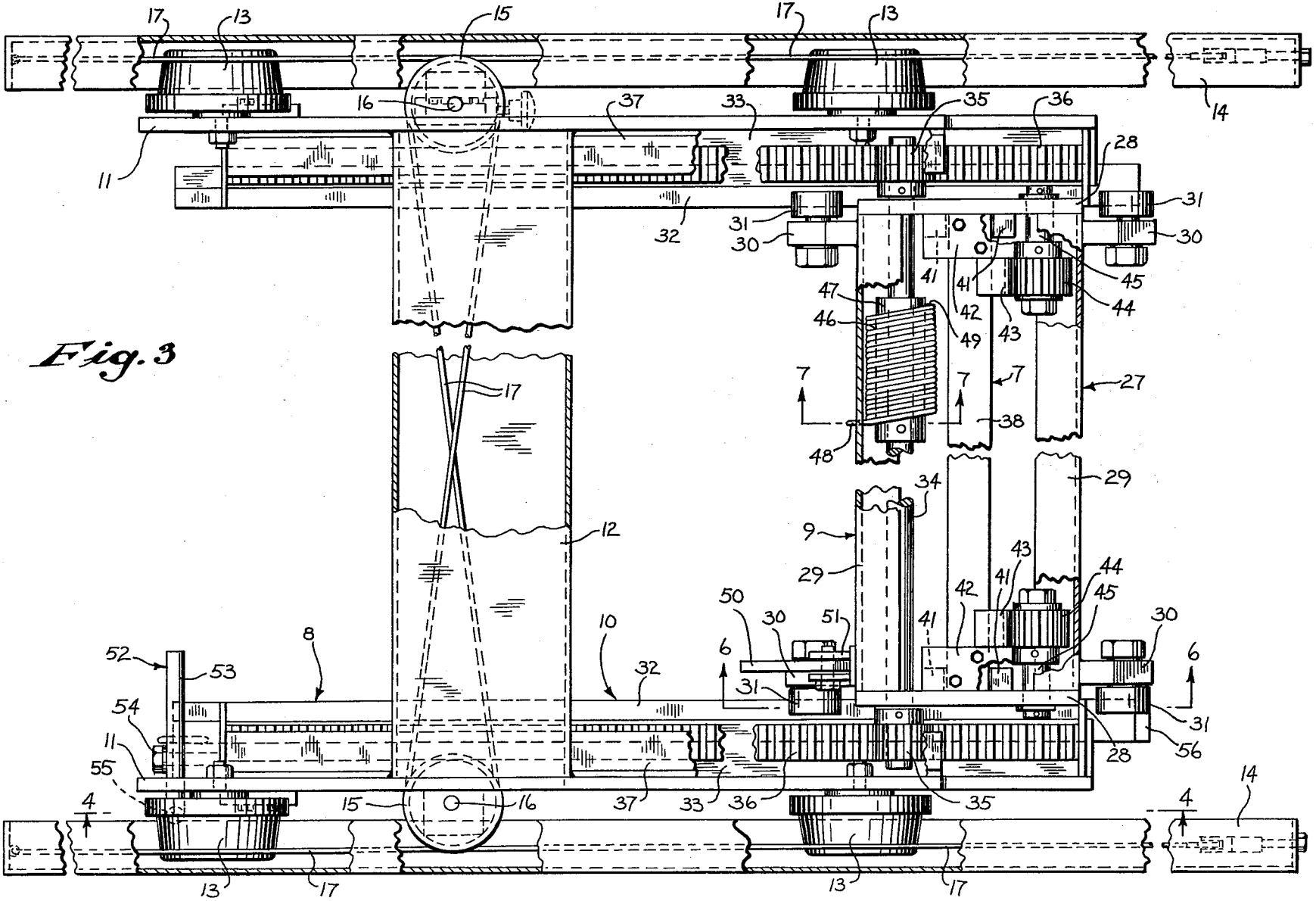
FIG. 3 is a plan view of the structure shown in FIG. 2.
Figure 4:
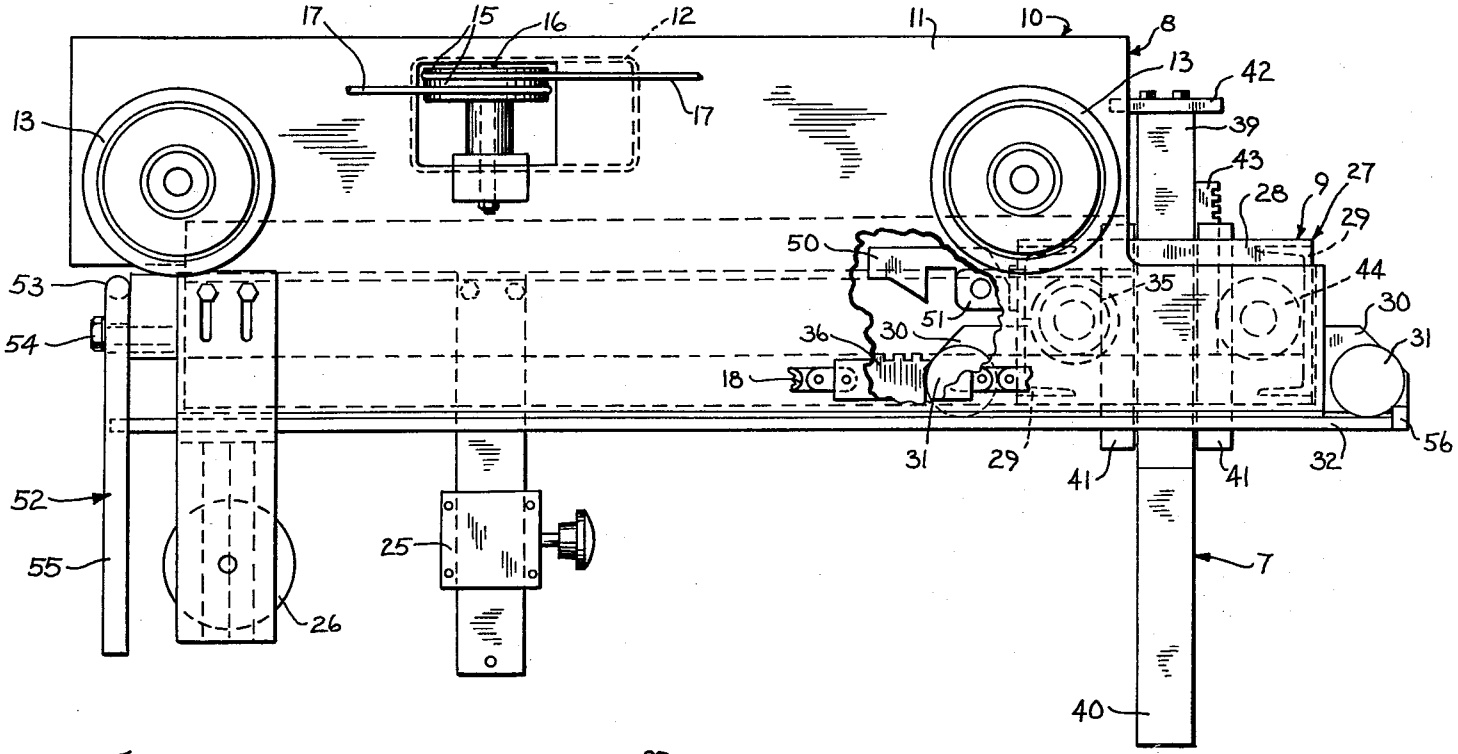
FIG. 4 is a section taken along line 4—4 of FIG. 3, showing the carriage in the rearmost position.
Figure 7:
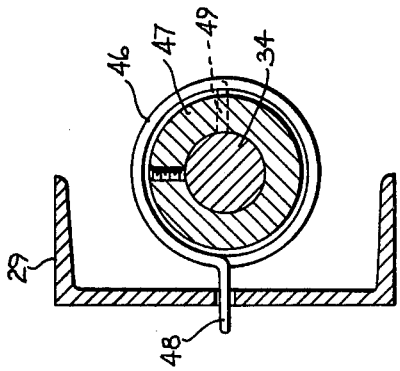
FIG. 7 is a section taken along line 7—7 of FIG. 3.
Figure 5:
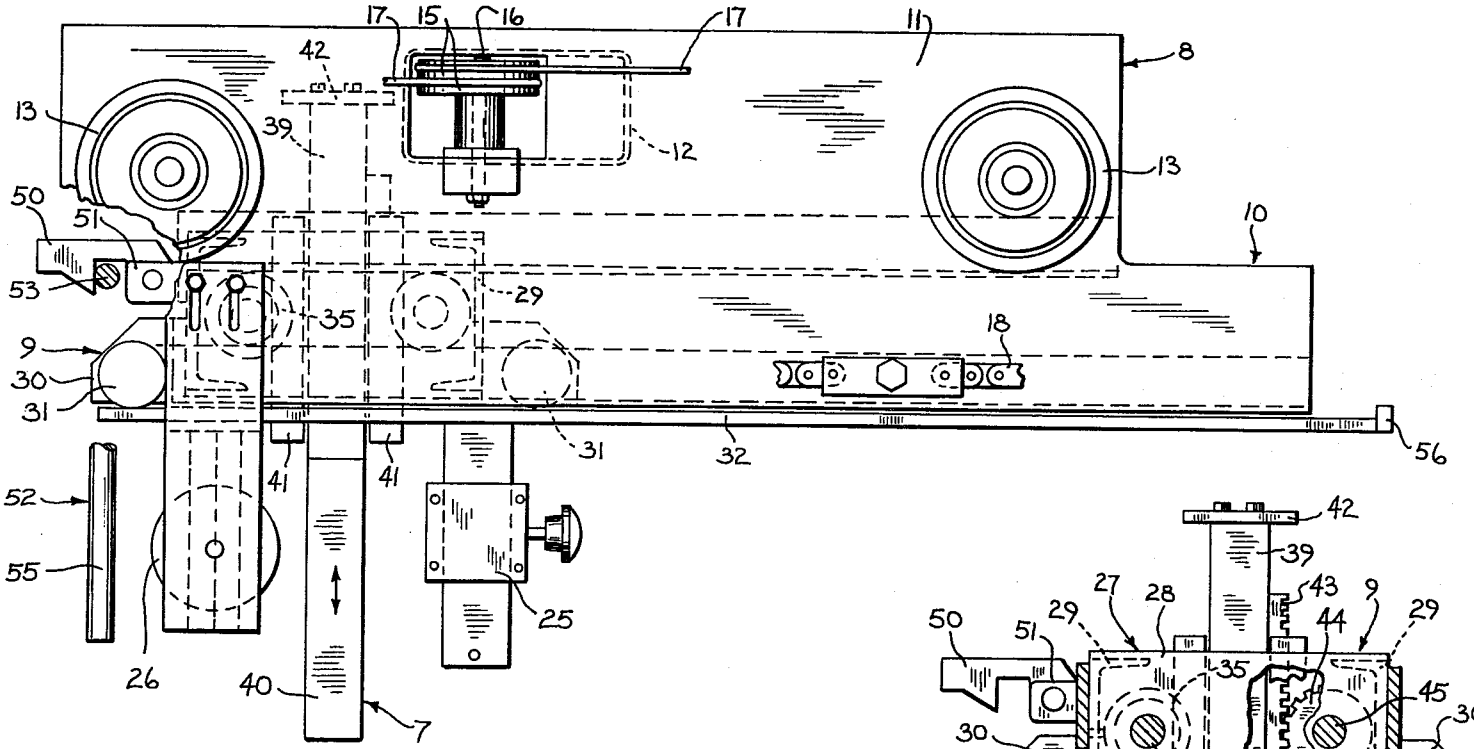
FIG. 5 is a view similar to FIG. 4 showing the carriage latched in the forward position.
Figure 6:
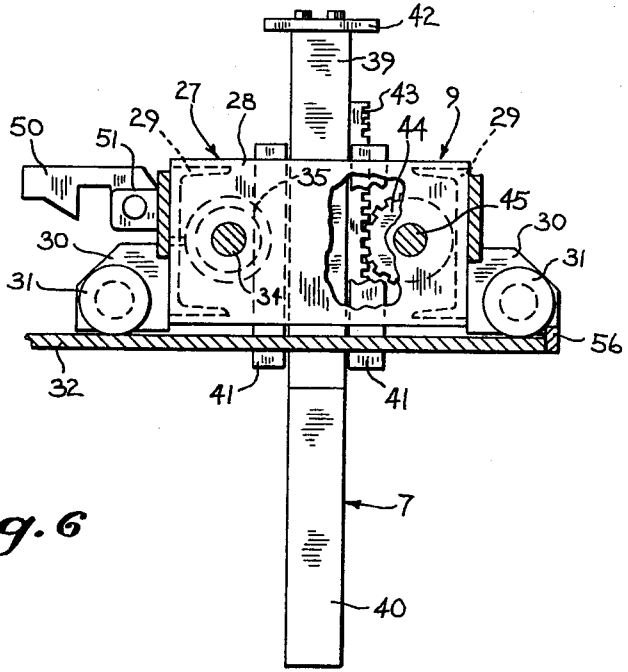
FIG. 6 is a section taken along line 6—6 of FIG. 3.

As shown in FIGS. 2–4, the truck 8 comprises a frame 10 which is composed of a pair of side plates 11 and a cross beam 12 which extends between the side plates 11. Each side plate 11 carries a pair of wheels 13 which ride on the lower flange of horizontal beams 14 of the frame 2.

To maintain alignment of the truck as it is moved on the beams 14 and prevent jamming, a pair of pulleys 15 are journalled on vertical shaft 16 which is carried by each of the side plates 11. Cables 17 connect the pulleys 15 at each side of the machine. Each cable is crossed in a generally X-shaped pattern and the ends of cables are dead-ended on the tracks 14. This cable arrangement maintains alignment of the sides of the truck frame 10 and prevents binding on the track 14 as the truck is moved relative to the machine frame.

The truck can be moved in a front-to-rear direction to vary the position of the back stop, depending on the length of sheets to be stacked by a chain drive mechanism which includes a pair of endless chains 18, and the chain located along each side of the machine is secured to the respective truck 8. The drive chains 18 are each trained over idler sprockets 19, which are secured to the ends of transverse shaft 20, and over drive sprockets 21, which are secured to shaft 22. Shaft 22 carries a sprocket 23 which is connected through chain 24 to a reversible drive mechanism, not shown. By operation of the drive mechanism, the chains 18 can be driven in synchronization to move the truck 8 on the guide track 14.

One of the side plates 11 carries a bracket on which a photoelectric cell 25 is mounted, while a mirror or reflector 26 is mounted on the opposite side wall. The photoelectric cell unit is part of the control mechanism which forms no part of the present invention and acts to control the movement of the lift frame when the stack reaches a predetermined height, as described in U.S. Pat. No. 3,905,595.

In accordance with the invention, the carriage 9, which carries the backstop 7, is adapted to be moved relative to the truck 8 so that the entire bed or frame of the machine can be utilized to accommodate the shortest and longest lengths of sheets 4.

As shown in FIGS. 2–4, the carriage 9 includes a frame 27 composed of a pair of side plates 28 that are connected together by channels 29 that extend transversely across the machine. Extensions 30 extend forwardly and rearwardly of the channels 29, and rollers 31 are journalled on the extensions and are adapted to ride on plate 32 which is connected through plate 33 to the side plates 11 of truck 8.

To maintain alignment of the carriage 9 on the truck 8, a shaft 34 extends across the machine, and the shaft is journalled in the side plates 28. The projecting ends of shaft 34 carry pinions 35 that ride on racks 36 as the carriage is moved relative to the truck. The rack and pinion arrangement maintains alignment of the carriage on the truck and prevents binding of the carriage. An angle 37 is attached to each side plate 11 of truck frame 10 and is located over the respective pinion to prevent upward tilting of the carriage relative to the truck.

The backstop 7 is composed of a vertical plate 38 which extends across the machine and the ends of the plate are attached to vertical columns 39. Extensions 40 extend laterally outward from the lower end of each column 39.

As a safety measure, the backstop 7 is mounted for free vertical movement with respect to the carriage 9. To provide this vertical movement, a pair of vertical guides 41 are mounted on each side plate 28 of the carriage and the columns 39 at each side of the backstop are guided in vertical movement between the guides 41. A stop plate 42 is secured to the upper end of each column and engagement of the stop plate with the upper ends of the guides 41 limits the downward movement of the backstop.

To prevent binding of the backstop plate 38 during vertical movement, a rack 43 is attached to each vertical column 39, and the rack is engaged by a pinion 44 carried by shaft 45 that extends inwardly from the respective side plate 28. The backstop 7 will normally be in its lowermost position with the stops 42 engaging the upper ends of the guides 41. As a safety measure, or in the event of any emergency, the backstop can freely be moved vertically within the guides and will return by gravity to its lowermost position.

The carriage 9 and backstop 7 are preferably biased to a rear or downstream position with respect to the truck 8 by a torsion spring 46. Torsion spring 46 is wound around a sleeve 47 that is secured to the shaft 34, and one end 48 of the torsion spring extends through a hole in one of the channels 29 while the opposite end 49 of the torsion spring extends through a hole in the sleeve 47. As the carriage 9 is moved forwardly on the truck 8, the force of the torsion spring will be increased with the result that the force of the spring will urge the carriage back to its rearmost position on the truck 8.

The carriage 9 and backstop 7 can be locked in a forward or upstream position with respect to the truck 8 by a dog 50 which is pivotally connected to a clevis 51 on the forward channel 29. When the carriage 9 is in a forward position, the dog 50 is adapted to engage the horizontal section 53 of an L-shaped latch rod 52. The latch rod 52 is pivotally connected by pin 54 to the truck 8 and the pivot point is located such that the gravity moment of the vertical section 55 about pin 54 will urge the horizontal end 53 of the latch rod to a generally horizontal latching position. By pulling outwardly on the vertical end of the latch rod, the latch rod 52 can be disengaged from the dog 50 so that the force of the torsion spring 46 will then return the carriage to its rearmost position with respect to the truck. Stop 56 is provided on the truck which limits the rearward movement of the carriage on the truck.

During normal operation of the stacking machine, the truck 8 can be moved in a fore-and-aft direction on the machine to position the backstop 7 at various predetermined positions depending on the length of the sheets to be stacked. The carriage 9 is normally at its rearward position on truck 8, but the carriage 9 can be manually moved forwardly relative to the truck, to thereby provide an added adjustment for the position of the backstop 7 so that the entire length of the machine frame or bed can be utilized for stacking of sheets. This enables sheets of greater length to be stacked on a machine of given dimension, or alternately, enables the length of the machine to be reduced for stacking of sheets of given length.

Various modes of carrying out the invention are contemplated as being within the scope of the following claims particularly pointing out and distinctly claiming the subject matter which is regarded as the invention.

I claim:

1. A machine for stacking sheet material, comprising a supporting structure, a conveyor mounted on the supporting structure to convey sheet material in a given direction, a lift table mounted on the supporting structure and disposed to receive a plurality of sheets and stack the sheets, a truck located above the table and mounted for movement with respect to said table in said direction, a carriage mounted for linear movement on the truck in said direction, said carriage being movable between a first position adjacent the upstream end of the truck to a second position adjacent the downstream end of the truck, latching means to lock the carriage in the first position, and a backstop carried by the carriage and disposed to be engaged by the leading ends of the sheets as they are stacked on the table.

2. The machine of claim 1, wherein said machine includes means to bias the carriage to the second downstream position.

3. The machine of claim 1, and including a track disposed along each side edge of said truck, said carriage including wheel means mounted on each side thereof and disposed to ride on the respective track.

4. The machine of claim 1, wherein said latching means comprising a dog pivotally mounted on the carriage and a latch on the truck, said dog being engageable with said latch to latch the carriage in the upstream position.

5. The machine of claim 1, and including mounting means for mounting the backstop for free vertical movement with respect to the carriage.

6. The machine of claim 3, and including a second track mounted on each side of the supporting structure, said truck having second wheel means on each side thereof with said second wheel means engaging said second tracks.

7. The machine of claim 6, and including drive means to drive the truck on said second track.

8. A machine for stacking sheet material, comprising a supporting structure, a lift table to receive a plurality of sheets being conveyed in a fore-to-aft direction and stack said sheets, said lift table being mounted for vertical movement with respect to the supporting structure, a truck located above the table and mounted for fore-to-aft movement on the supporting structure, a carriage mounted on the truck in said direction, a backstop carried by the carriage and disposed to be engaged by the forward edges of the sheets as they are being stacked on the table, said backstop being movable on said carriage between a rear position and a forward position, biasing means for biasing the backstop to the rear position, and latch means for latching the backstop in the forward position.

9. The machine of claim 8, and including a track mounted on each side of the truck, said carriage including wheel means to ride on the respective tracks, and said machine including guide means for maintaining alignment of the carriage on the truck as the carriage moves on said tracks.

10. The machine of claim 8, wherein said biasing means comprises a torsion spring.

11. The machine of claim 8, wherein said carriage includes a frame, a shaft extending generally normal to said direction and journalled in said frame, a pinion carried by each end of the shaft, a rack mounted on each side of the truck and disposed to be engaged by the respective pinion, one end of the torsion spring being engaged with the frame and the opposite end of the torsion spring being engaged with the shaft, whereby movement of said carriage toward said forward position will increase the force of said torsion spring to thereby urge said carriage to the rear position.

* * * * *